US010556423B2

(12) United States Patent
Anzai

(10) Patent No.: US 10,556,423 B2
(45) Date of Patent: Feb. 11, 2020

(54) LIQUID EJECTING APPARATUS AND DETECTING METHOD OF INTERFERENCE SUBSTANCE

(71) Applicant: SEIKO EPSON CORPORATION, Tokyo (JP)

(72) Inventor: Sumito Anzai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/030,715

(22) Filed: Jul. 9, 2018

(65) Prior Publication Data

US 2019/0016120 A1 Jan. 17, 2019

(30) Foreign Application Priority Data

Jul. 13, 2017 (JP) ..... 2017-137223

(51) Int. Cl.
*B41J 2/045* (2006.01)

(52) U.S. Cl.
CPC ..... *B41J 2/04505* (2013.01); *B41J 2/04586* (2013.01)

(58) Field of Classification Search
CPC ..... B41J 2/04505; B41J 2/04586; B41J 11/0095; B41J 2/01; G01V 8/10
See application file for complete search history.

(56) References Cited

U.S. PATENT DOCUMENTS

| | | | | |
|---|---|---|---|---|
| 6,827,414 | B2 | 12/2004 | Iwatsuki et al. | |
| 2003/0197750 | A1 | 10/2003 | Iwatsuki et al. | |
| 2016/0129706 | A1* | 5/2016 | Maekawa | B41J 2/325 347/16 |
| 2016/0214419 | A1 | 7/2016 | Mashima | |

FOREIGN PATENT DOCUMENTS

| | | | |
|---|---|---|---|
| JP | 2003-311938 | A | 11/2003 |
| JP | 2014-094370 | A | 5/2014 |
| JP | 2016-137586 | A | 8/2016 |

* cited by examiner

*Primary Examiner* — Bradley W Thies
(74) *Attorney, Agent, or Firm* — Workman Nydegger

(57) ABSTRACT

A liquid ejecting apparatus includes an ejecting unit capable of ejecting a liquid, a support unit configured to support a medium onto which the liquid is ejected and is movable in a movement direction between a set position where the medium is set and an ejecting start position where the ejecting unit starts ejecting the liquid, and a detector configured to detect whether an interference substance which is a substance that causes an interference with the ejecting unit is present on the support unit. The detector is movable between a first position and a second position, a distance between the second position and the ejecting unit being longer than a distance between the first position and the ejecting unit, in the movement direction.

12 Claims, 12 Drawing Sheets

LIQUID EJECTING APPARATUS AND DETECTING METHOD OF INTERFERENCE SUBSTANCE

BACKGROUND

1. Technical Field

The disclosure relates to a liquid ejecting apparatus and a detecting method of an interference substance.

2. Related Art

Liquid ejecting apparatuses of various configurations are used. Among such liquid ejecting apparatuses, a liquid ejecting apparatus is used, in which, for example, an ejecting unit ejects a liquid such as ink onto a medium supported by a support unit, and thus an image is formed. For example, an ink jet printer (a liquid ejecting apparatus) is disclosed (refer to JP-A-2003-311938, for example). In the ink jet printer, a print head (an ejecting unit) ejects ink onto a material to be printed on (a medium) supported by a platen (a support unit), and thus forming an image.

In a liquid ejecting apparatus including an ejecting unit that ejects a liquid onto a medium supported by a support unit, and thus forming an image, an interference substance such as a foreign material that adheres to the medium or a crease formed on the medium may interfere with the ejecting unit.

Hence, the ink jet printer disclosed in JP-A-2003-311938 includes a sensor (a detector) capable of detecting an interference substance to prevent the interference substance from interfering with the print head. The detector capable of detecting an interference substance may be disposed close to the ejecting unit, in view of preventing an increase in size of the apparatus. Specifically, when the detector is disposed on a position far from the ejecting unit, the support unit is moved to a position of the detector far from the ejecting unit to detect an interference substance. Therefore, the apparatus tends to increase in size. On the other hand, when the detector is disposed on a position close to the ejecting unit, mist of a liquid ejected from the ejecting unit easily adheres to the detector. This phenomenon may lower detection accuracy. That is, the detector is disposed close to the ejecting unit (in other words, a conveyance path of the medium may be shortened) to prevent an increase in size of the apparatus. On the other hand, the detector is disposed far from the ejecting unit to prevent a decrease in detection accuracy for an interference substance. In such a liquid ejecting apparatus in the related art as disclosed in JP-A-2003-311938, preventing an increase in size of the apparatus may be incompatible with preventing a decrease in detection accuracy for an interference substance with respect to the ejecting unit.

SUMMARY

According to this disclosure, an increase in size of an apparatus is prevented and a decrease in detection accuracy for an interference substance with respect to an ejecting unit is also prevented.

A liquid ejecting apparatus according to a first aspect of the disclosure includes an ejecting unit capable of ejecting a liquid, a support unit configured to support a medium onto which the liquid is ejected and is movable in a movement direction between a set position where the medium is set and an ejecting start position where the ejecting unit starts ejecting the liquid, and a detector configured to detect whether an interference substance which is a substance that causes an interference with the ejecting unit is present on the support unit. The detector is movable between a first position and a second position, and a distance between the second position and the ejecting unit is longer than a distance between the first position and the ejecting unit, in the movement direction.

In the first aspect, the detector is movable between the first position and the second position, and the distance between the second position and the ejecting unit is longer than the distance between the first position and the ejecting unit, in the movement direction. Therefore, the liquid ejecting apparatus according to the first aspect of the disclosure causes the detector to detect an interference substance at the first position close to the ejecting unit and then to move to the second position farther from the ejecting unit to eject liquid. This operation shortens a conveyance path of the medium and also prevents mist of ink ejected from the ejecting unit from adhering to the detector. The liquid ejecting apparatus according to the first aspect of the disclosure, while preventing an increase in size, prevents a decrease in detection accuracy for an interference substance with respect to the ejecting unit.

The liquid ejecting apparatus according to a second aspect of the disclosure is the liquid ejecting apparatus in the first aspect of the disclosure. The ejecting unit may be capable of ejecting the liquid onto the medium between a first end portion locating on the set position side of the support unit when the support unit is located at the set position and a second end portion locating on the ejecting start position side of the support unit when the support unit is located at the ejecting start position, in the movement direction, and the first position and the second position may be located on the ejecting start position side with respect to the ejecting unit in the movement direction.

In the second aspect, a movement range of the detector is located on the ejecting start position side with respect to the ejecting unit, in the movement direction. Therefore, in the liquid ejecting apparatus according to the second aspect of the disclosure, the detector is prevented from becoming an interference when a medium is set in the support unit, for example.

The liquid ejecting apparatus according to a third aspect of the disclosure is the liquid ejecting apparatus in the first aspect of the disclosure. The ejecting unit may be capable of ejecting the liquid onto the medium between a first end portion locating on the set position side of the support unit when the support unit is located at the set position and a second end portion locating on the ejecting start position side of the support unit when the support unit is located at the ejecting start position, in the movement direction, and the first position and the second position may be located on the set position side with respect to the ejecting unit in the movement direction.

In the third aspect, a movement range of the detector may be located on the set position side with respect to the ejecting unit, in the movement direction. Therefore, in the liquid ejecting apparatus according to the third aspect of the disclosure, a conveyance path of the medium on the ejecting start position side in the movement direction is shortened efficiently, in particular.

The liquid ejecting apparatus according to a fourth aspect of the disclosure is the liquid ejecting apparatus in the first aspect of the disclosure. The ejecting unit may be capable of ejecting the liquid onto the medium between a first end portion locating on the set position side of the support unit when the support unit is located at the set position and a second end portion locating on the ejecting start position side of the support unit when the support unit is located at the ejecting start position, in the movement direction. One of the first position and the second position may be located on the set position side with respect to the ejecting unit in the movement direction, and the other one of the first position and the second position may be located on the ejecting start position side with respect to the ejecting unit in the movement direction.

In the fourth aspect, a movement range of the detector may be between the set position side and the ejecting start position side, in the movement direction. Therefore, in the liquid ejecting apparatus according to the fourth aspect of the disclosure, imbalance in a conveyance path of the medium is prevented in the movement direction.

The liquid ejecting apparatus according to a fifth aspect of the disclosure is the liquid ejecting apparatus in the fourth aspect of the disclosure. The first position may be located on the set position side with respect to the ejecting unit in the movement direction, and the second position may be located on the ejecting start position side with respect to the ejecting unit in the movement direction.

In the fifth aspect, an interference substance is detected on the set position side, and thus the interference substance is detected soon after the medium is set.

The liquid ejecting apparatus according to a sixth aspect of the disclosure is the liquid ejecting apparatus in the fourth aspect of the disclosure. The first position may be located on the ejecting start position side with respect to the ejecting unit in the movement direction, and the second position may be located on the set position side with respect to the ejecting unit in the movement direction.

In the sixth aspect, an interference substance is detected on the ejecting start position side, and thus the interference substance is detected close to an ink-ejecting area of the ejecting unit (in other words, immediately before an ejecting operation).

The liquid ejecting apparatus according to a seventh aspect of the disclosure is the liquid ejecting apparatus in any one of the first to sixth aspects of the disclosure. The liquid ejecting apparatus may include a movement mechanism configured to move the detector to the first position and the second position, and a controller configured to control the detector to move to the first position and the second position. In the liquid ejecting apparatus according to the seventh aspect of the disclosure, the controller may locate the detector at the second position at least when the ejecting unit ejects the liquid.

In the seventh aspect, a controller may control the detector to locate at the second position when the ejecting unit ejects the liquid and thus the detector is moved automatically to the first position and the second position as appropriate.

A detecting method of an interference substance with respect to an ejecting unit in a liquid ejecting apparatus, according to an eighth aspect of the disclosure, the liquid ejecting apparatus including an ejecting unit capable of ejecting a liquid, a support unit configured to support a medium onto which the liquid is ejected, the support unit being movable in a movement direction between a set position where the medium is set and an ejecting start position where the ejecting unit starts ejecting the liquid, and a detector configured to detect whether an interference substance which is a substance that causes an interference with the ejecting unit is present on the support unit, and the detecting method includes performing a detecting operation of detecting an interference substance with the detector located at a first position, without causing the ejecting unit to eject the liquid, and performing an ejecting operation of causing the ejecting unit to eject the liquid with the detector located at the second position, a distance between the second position and the ejecting unit being longer than a distance between the first position and the ejecting unit, in the movement direction.

In the eighth aspect, the detector is located at the first position without ejecting a liquid from the detector, a detecting operation is performed for an interference substance, and the detector is located at the second position. A distance between the second position and the ejecting unit is longer than a distance between the first position and the ejecting unit, in the movement direction, and an ejecting operation is performed. Therefore, in the detecting method according to the eighth aspect of the disclosure, after performing the detecting operation, the detector is moved to the second position farther from the ejecting unit and an ejecting operation is performed. This method shortens the conveyance path of the medium and also prevents the mist of the liquid ejected from the ejecting unit from adhering to the detector. The liquid ejecting apparatus according to the disclosure, while preventing an increase in size, prevents a decrease in detection accuracy for an interference substance with respect to the ejecting unit.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

The following describes in detail a printing apparatus 1 as a liquid ejecting apparatus according to an example of the disclosure with reference to the accompanying drawings.

EXAMPLE 1

FIGS. 1 to 6

Figure 1:
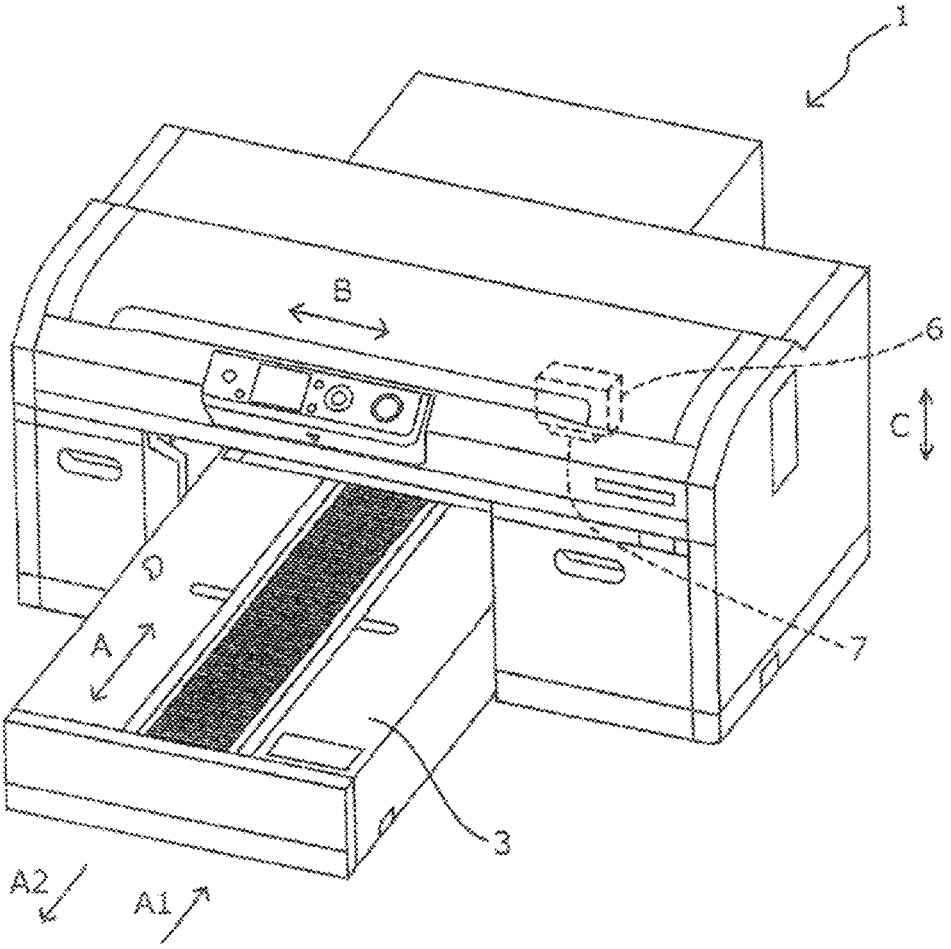
FIG. 1 is a schematic perspective view of a printing apparatus according to Example 1 of the disclosure.
Figure 2:
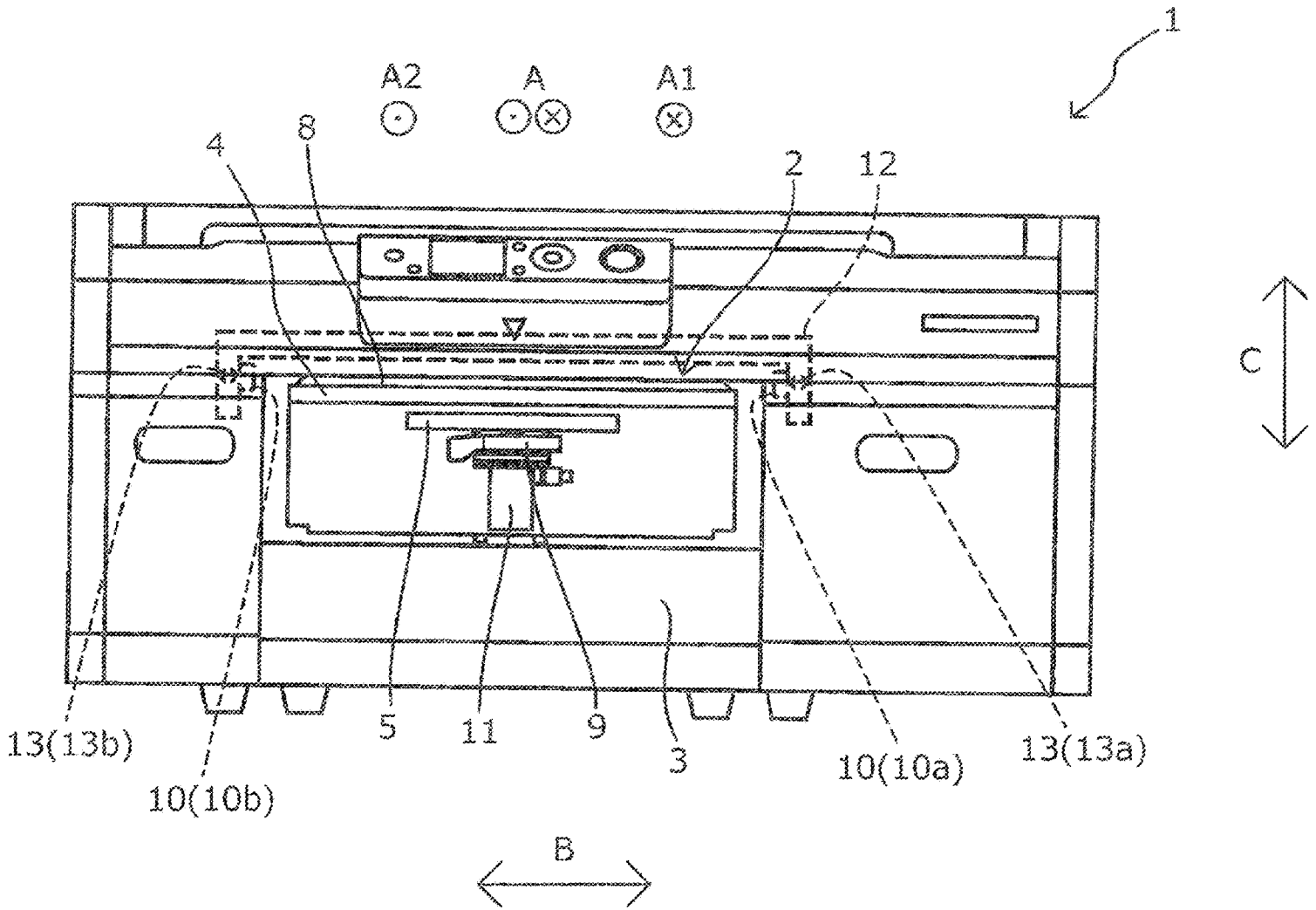
FIG. 2 is a schematic front view of the printing apparatus according to Example 1 of the disclosure.
Figure 3:
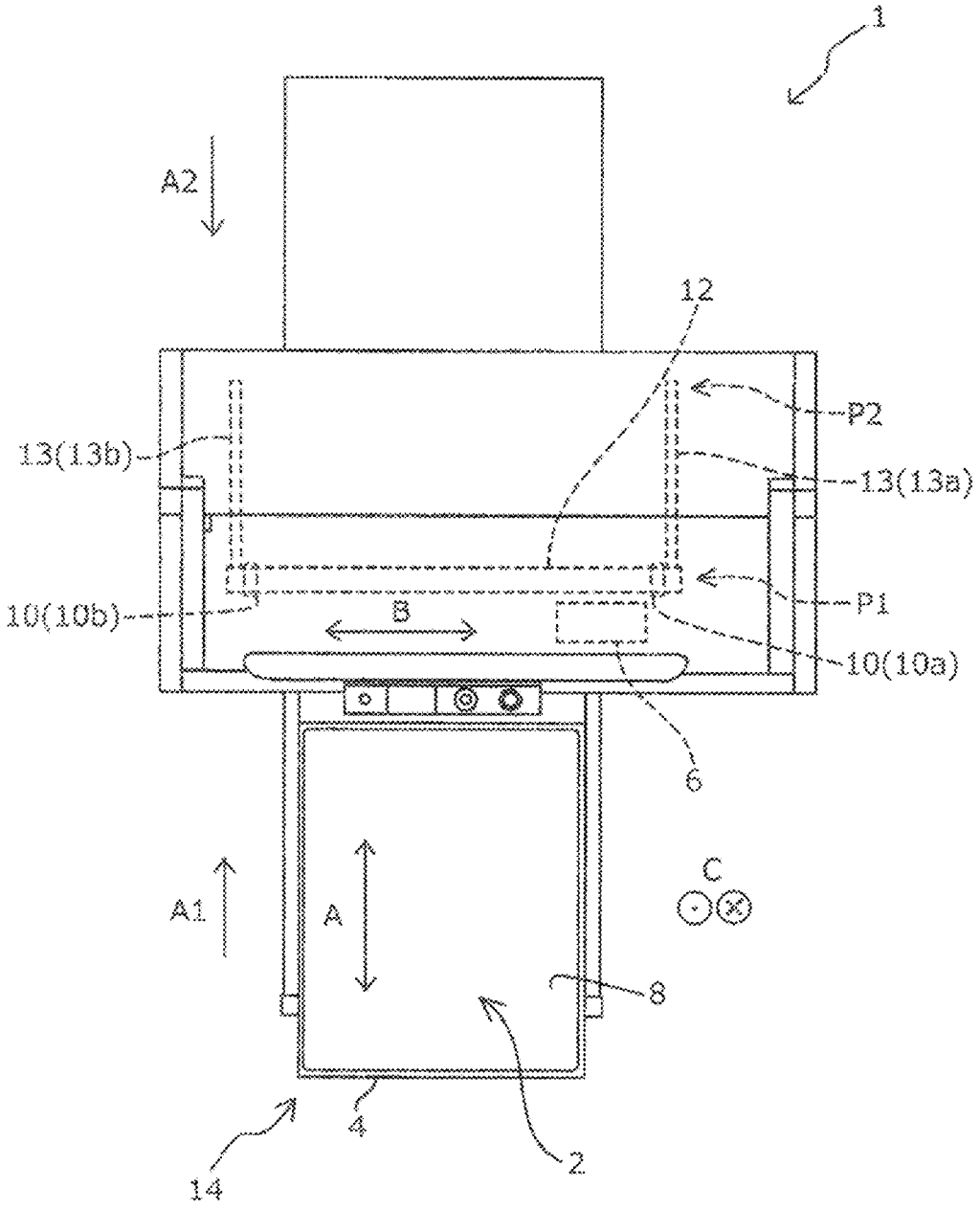
FIG. 3 is a schematic plan view of the printing apparatus according to Example 1 of the disclosure.

FIG. 1 is a schematic perspective view of a printing apparatus 1 according to Example 1. FIG. 1 illustrates a state in which a medium support unit 2 is located at a printing start position, that is, the start position where a print head 7 starts an ejection. FIG. 2 is a schematic front view of the printing apparatus 1 according to Example 1. FIG. 3 is a schematic plan view of the printing apparatus 1 according to Example 1. FIG. 3 illustrates a state in which a medium support unit 2 is in a set position 14 of a medium. Note that FIG. 1 to FIG. 3 illustrate some constituent elements in a simplified manner.

The printing apparatus 1 according to Example 1 includes the medium support unit 2. The medium support unit 2 includes a tray 4 serving as a support unit. The tray 4 includes a support surface 8, which supports a medium. The medium support unit 2 moves in a movement direction A while supporting a medium on the support surface 8 of the tray 4. The printing apparatus 1 also includes a medium conveyance unit 3 configured to convey the medium supported by the tray 4 in the movement direction A. The movement direction A is a direction including a direction A1 and a direction A2 opposite from the direction A1.

The medium support unit 2 is detachably installed on a stage 5. An attachment and detachment direction C, in which the medium support unit 2 is attached to or detached from the stage 5, corresponds to the vertical direction for the printing apparatus 1 according to Example 1. Rotating a lever 9 causes the medium support unit 2 to move in the attachment and detachment direction C (in the vertical direction) along with the stage 5. As illustrated in FIG. 2, the lever 9 is provided at an arm member 11. A variety of materials may be used as the medium, including textiles (fabric, cloth, and the like), paper, vinyl chloride resin, and the like.

The printing apparatus 1 includes, in its interior, the print head 7 serving as an ejecting unit capable of printing (forming an image) onto a medium by ejecting ink which is an example of a liquid. The printing apparatus 1 according to Example 1 reciprocates a carriage 6, which retains the print head 7, in a scanning direction B which intersects with the movement direction A. The printing apparatus 1 forms an intended image by ejecting ink from the print head 7 onto a medium supported by the tray 4 while reciprocating the print head 7 in the scanning direction B. Note that in the printing apparatus 1 according to Example 1, the front side (the lower-left) in FIG. 1 corresponds to a set position 14 for setting the medium to the tray 4 (refer to FIG. 3). The tray 4 on which the medium is set is moved in the direction A1 of the movement direction A until the tray 4 reaches the ejecting start position 15 (refer to FIG. 6), which corresponds to the back side (the upper-right) in FIG. 1. Printing is then carried out while the tray 4 is moved in the direction A2 of the movement direction A. In addition to the print head 7, a pretreatment agent applier, for example, may also be included, which is capable of applying a pretreatment agent onto a medium before an ejecting operation by the print head 7.

Figure 5:
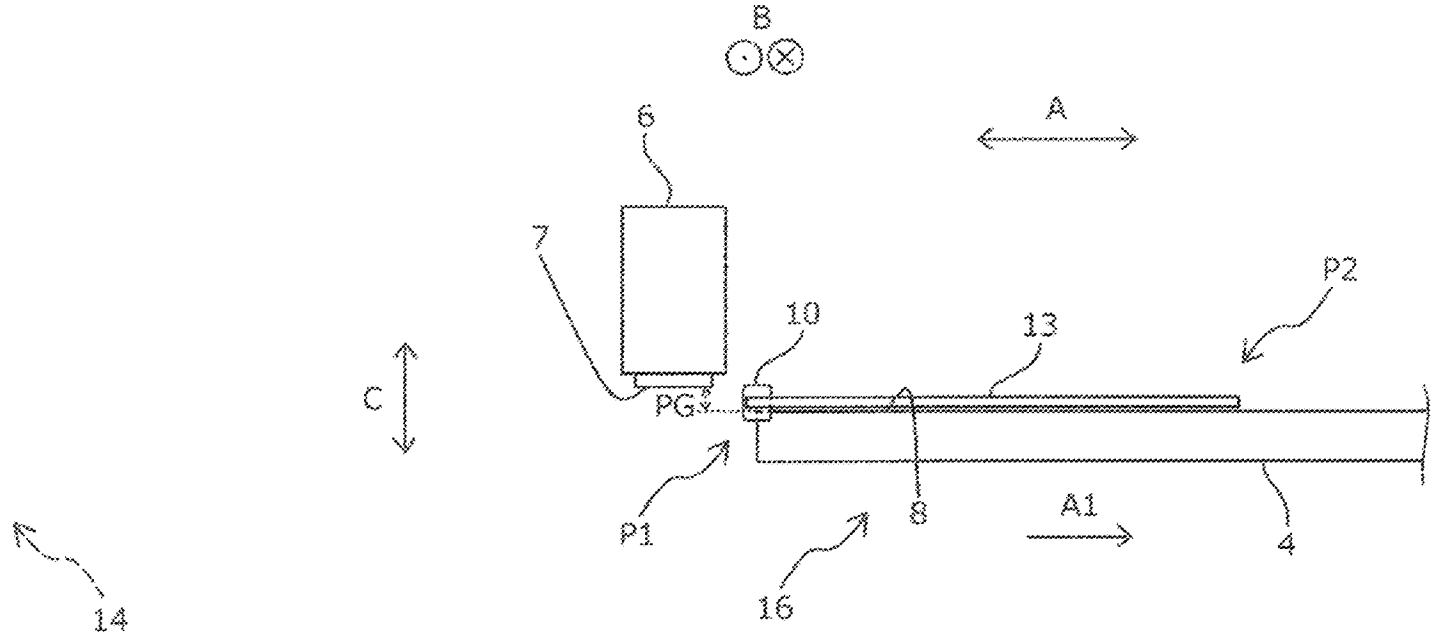
FIG. 5 is a schematic side view illustrating main components of the printing apparatus according to Example 1 of the disclosure.

The printing apparatus 1 includes, in its interior, a sensor 10 serving as a detector capable of detecting a platen gap (PG) between the print head 7 and the tray 4 when they face each other and a medium is set in the tray 4 (refer to FIG. 5). Specifically, the sensor 10 is capable of detecting whether the PG is within a specified range (or below the specified range). The sensor 10 is configured to measure the PG and thus detect whether a substance (an interference substance) that may interfere with the print head 7 is present on the tray 4. "Interference substance" refers to a foreign material adhered to a medium and includes a crease formed on a medium. The sensor 10 is provided at an arch member 12 which is movable in the movement direction A along a rail 13. Specifically, the sensor 10 includes a light emitting member 10*a* and a light receiving member 10*b*. The light receiving member 10*b* detects a light emitted from the light emitting member 10*a* to the light receiving member 10*b* and thus the sensor 10 detects the PG. As illustrated in FIGS. 2 and 3, of the rail 13, a rail disposed on the light emitting member 10*a* side is a rail 13*a* and a rail disposed on the light emitting member 10*b* side is a rail 13*b*.

The sensor 10 according to Example 1 is provided at the arch member 12, which is movable in the movement direction A along the rail 13. The arch member 12 is moved in the movement direction A along the rail 13, and thus the sensor 10 is movable to a first position P1 and a second position P2. Note that the configuration of the sensor 10 is not limited to this example. Another configuration is also applicable as long as the sensor 10 is movable to the first position P1 and the second position P2. However, in a case where such a detector including a plurality of components (such as the light emitting member 10*a* and the light receiving member 10*b*) is used, like the sensor 10 according to Example 1, the configuration in which the plurality of components integrally move, like the configuration according to in Example 1, is applicable. This configuration prevents a decrease in detection accuracy caused by, for example, movement displacement of the plurality of components in the sensor 10. The sensor 10, which is one of main components of the printing apparatus 1 according to Example 1, will be described in detail later.

Figure 4:
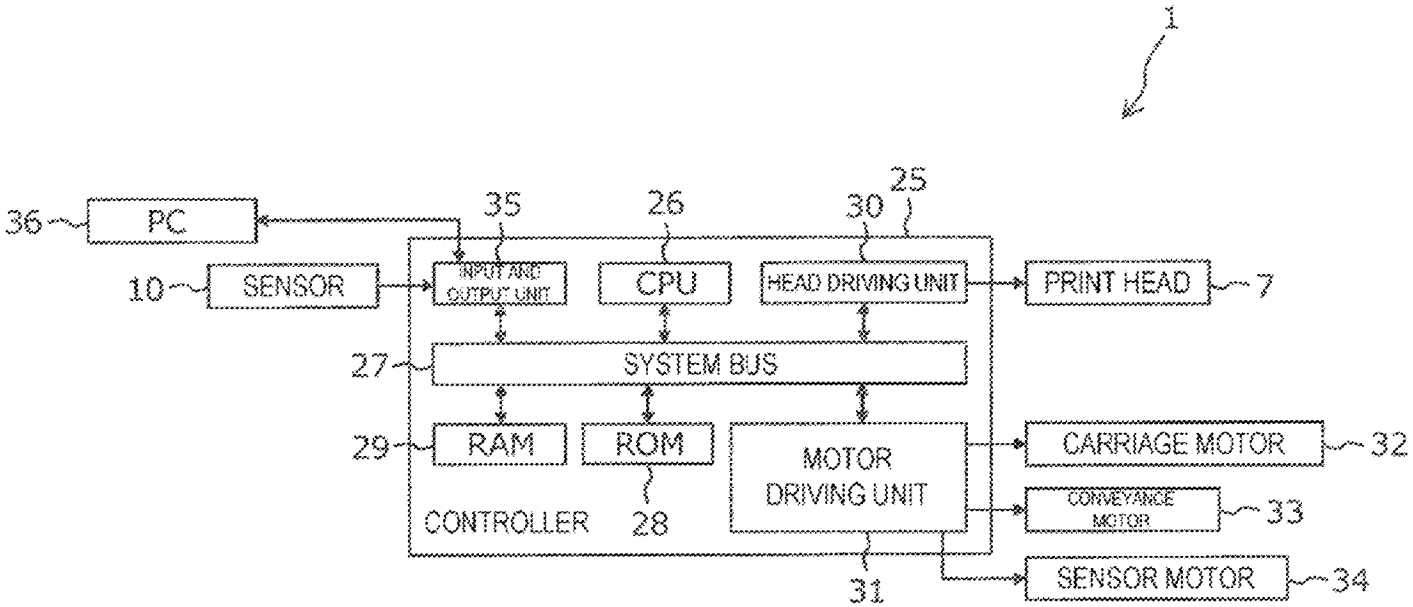
FIG. 4 is a block diagram illustrating the printing apparatus according to Example 1 of the disclosure.

Next, an electrical configuration of the printing apparatus 1 according to Example 1 will be described. FIG. 4 is a block diagram illustrating the printing apparatus 1 according to Example 1. A central processing unit (CPU) 26 is disposed in a controller 25 and controls the printing apparatus 1 as a whole. The CPU 26 is connected to read-only memory (ROM) 28 and random-access memory (RAM) 29 via a system bus 27. The ROM 28 stores various control programs to be executed by the CPU 26. The RAM 29 temporarily stores data.

The CPU 26 is also connected to a head driving unit 30, which drives the print head 7 via the system bus 27. The CPU 26 is furthermore connected to a motor driving unit 31 via the system bus 27. The motor driving unit 31 is connected to a carriage motor 32, a conveyance motor 33, and a sensor motor 34. The carriage motor 32 moves the carriage 6, on which the print head 7 is disposed in the scanning direction B. The conveyance motor 33 conveys the medium (in other words, moves the tray 4 in the movement direction A). The sensor motor 34 moves the arch member 12, on which the sensor 10 is disposed. The CPU 26 is furthermore connected to an input and output unit 35 via the system bus 27. The input and output unit 35 is connected to a personal computer (PC) 36.

Figure 6:
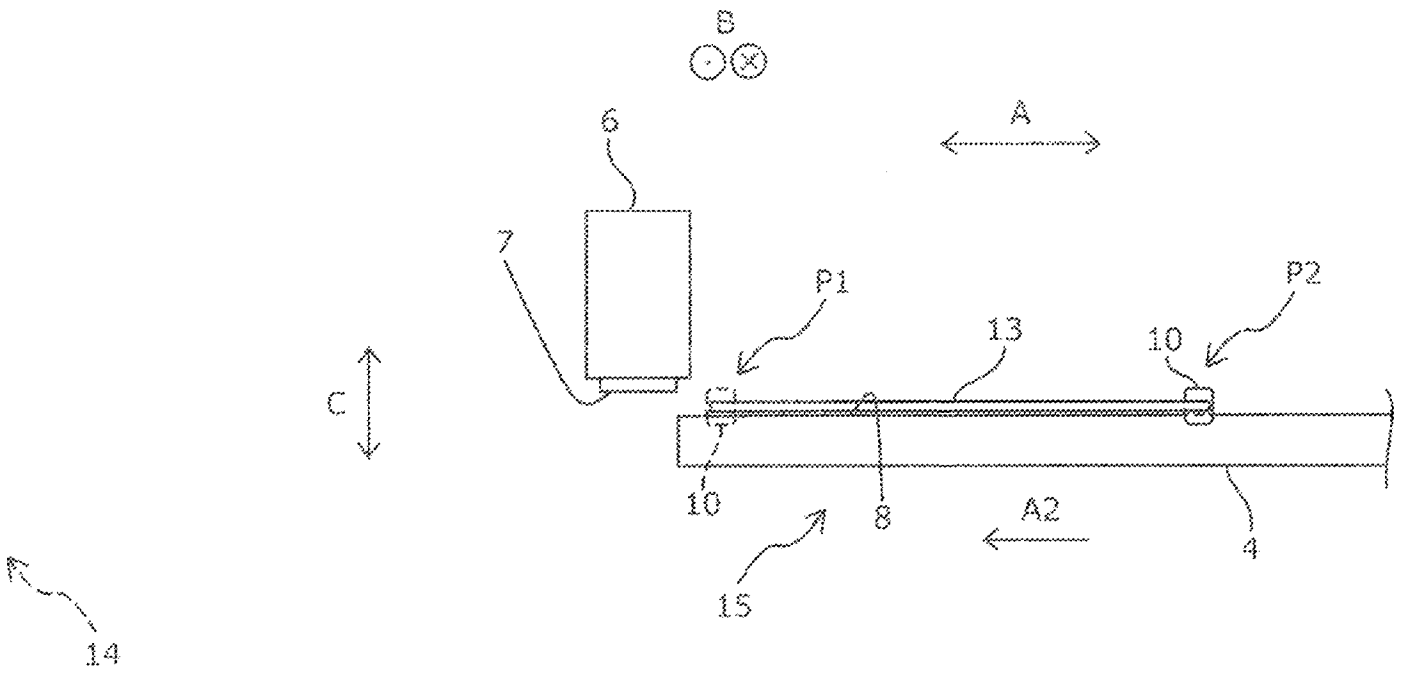
FIG. 6 is a schematic side view illustrating the main components of the printing apparatus according to Example 1 of the disclosure.

The sensor 10, which is one of the main components of the printing apparatus 1 according to Example 1, will be described. FIGS. 5 and 6 are schematic side views each illustrating a peripheral area of the sensor 10 of the printing apparatus 1 according to Example 1. FIG. 5 illustrates the state in which the sensor 10 is located at the first position P1 immediately after the sensor 10 has completed measuring a PG with respect to the tray 4, which moves in the direction A1. FIG. 6 illustrates the state immediately before start of printing (the state in which the tray 4 moving in the direction A2 is located at the ejecting start position 15) and the sensor 10 is located at the second position P2 (the state in which the sensor 10 has moved from the first position P1 to the second position P2, as indicated with the dashed line). In FIGS. 5 and 6, some components are omitted, such as a housing of the printing apparatus 1, the medium set in the tray 4, and the arch member 12, for easy recognition of the position of the sensor 10, for example.

As described above, the sensor 10 according to Example 1 is movable in the movement direction A along the rail 13. The printing apparatus 1 according to Example 1 causes the tray 4 to move in the direction A1 from the set position 14 (refer to FIG. 3) to a PG measurement end position 16 which is a position of the tray 4 in the movement direction A as illustrated in FIG. 5. The printing apparatus 1 then causes the tray 4 to move from the PG measurement end position 16 in the direction A2 and to be located at the ejecting start position 15. Subsequently, the printing apparatus 1 performs a printing operation (an ink-ejecting process) while causing the tray 4 to move in the direction A2. While the printing apparatus 1 causes the tray 4 to move from the set position 14 to the PG measurement end position 16, the sensor 10 is located at the first position P1. In the meantime, while the tray 4 is located at a position where the sensor 10 is capable of detecting the PG in the movement direction A, the sensor 10 detects the PG (a detecting process of a PG). Once the tray 4 is removed from the position where the sensor 10 is capable of detecting the PG at the first position P1 in the movement direction A (in other words, once the tray 4 is moved to the PG measurement end position 16), the sensor 10 moves to the second position P2, as illustrated in FIG. 6.

The PG detection position may be disposed closer to the print head 7 (specifically, an ink-ejecting area by the print head 7). This is because a configuration in which the PG detection position is far from the print head 7 may increase the size of the apparatus and lower the detection accuracy for the PG. For this reason, as illustrated in FIGS. 5 and 6, in the printing apparatus 1 according to Example 1, the first position P1, which is the PG detection position, is close to the print head 7. However, in a case where the sensor 10 is close to the print head 7 after start of printing operation, mist of ink is likely to adhere to the sensor 10. This may lower the detection accuracy of the sensor 10 for the PG. For this reason, in the printing apparatus 1 according to Example 1, before start of printing operation, the sensor 10 is receded from an area close to the print head 7 (in other words, moved to the second position P2).

In brief, the printing apparatus 1 according to Example 1 includes the print head 7, the tray 4, and the sensor 10. The print head 7 is capable of ejecting ink. The tray 4 supports a medium onto which the ink is ejected and is movable in the movement direction A between the set position 14 where the medium is set and the ejecting start position 15 where the print head 7 starts ejecting the ink. The sensor 10 detects whether an interference substance that may interfere with the print head 7 is present on the tray 4. The sensor 10 is movable between the first position P1 and the second position P2. A distance between the second position P2 and the print head 7 is longer than a distance between the print head 7 and the first position P1, in the movement direction A. For this reason, the printing apparatus 1 according to Example 1 causes the sensor 10 to detect an interference substance at the first position P1 close to the print head 7 and then to move to the second position P2 farther from the print head 7 to eject ink. This operation enables a conveyance path of the medium to be short and also prevents the mist of ink ejected from the print head 7 from adhering to the sensor 10. Therefore, the printing apparatus 1 according to Example 1, while preventing an increase in size, prevents lowering of the detection accuracy for an interference substance that may interfere with the print head 7.

In other words, the printing apparatus 1 according to Example 1 includes the print head 7 capable of ejecting ink, the tray 4, and the sensor 10. The tray 4 which supports a medium onto which the ink is ejected and is movable in the movement direction A between the set position 14 where the medium is set and the ejecting start position 15 where the print head 7 starts ejecting the ink. The sensor 10 which detects whether an interference substance that may interfere with the print head 7 is present on the tray 4. By using the printing apparatus 1 according to Example 1, a detecting method of an interference substance may be performed on the print head 7. The detecting method includes a detecting process and an ejecting process. In the detecting process, the sensor 10 is located at the first position P1 without ejecting ink from the print head 7, and a detecting operation is performed on an interference substance. In the ejecting process, the sensor 10 is located at the second position P2. The distance between the second position P2 and the print head 7 is longer than a distance between the print head 7 and the first position P1, in the movement direction A, and an ejecting operation is performed by causing the ink to be ejected from the print head 7. After the detecting operation is performed at the first position P1 close to the print head 7, the sensor 10 is moved to the second position P2 farther from the print head 7 to perform the ejecting operation. This method shortens the conveyance path of the medium and also prevents the mist of the ink ejected from the print head 7 from adhering to the detector. Therefore, by performing above-described detecting method of an interference substance, an increase in size of the apparatus is prevented and a decrease in detection accuracy for an interference substance with respect to the print head 7 is also prevented. The movement direction between the first position P1 and the second position P2 may be along the movement direction A, like the printing apparatus 1 according to Example 1. The movement direction between the first position P1 and the second position P2 may also be angled with respect to the movement direction A.

The printing apparatus 1 according to Example 1 includes a sensor motor 34, a not-illustrated belt, and a not-illustrated gear. The printing apparatus 1 also includes a movement mechanism which moves the sensor 10 to the first position P1 and the second position P2. The controller 25 controls the sensor motor 34, for example, and thus controls the sensor 10 to move to the first position P1 and the second position P2. The controller 25 locates the sensor 10 at the second position P2 at least when the print head 7 ejects ink. Therefore, the printing apparatus 1 according to Example 1 is capable of automatically moving the sensor 10 to the first position P1 and the second position P2 as appropriate.

The controller 25 controls the sensor 10 to perform a detection process for the PG when the sensor 10 is located at the first position P1. The controller 25 is capable of controlling the sensor 10 to perform a detection process for detecting the PG also when the sensor 10 is located at the second position P2. For example, as the ejecting operation proceeds, an amount of ink applied to the medium increases. This phenomenon may cause a crease on a rear side portion of the medium in the direction A2 along with swelling of the medium. Such a crease is easily detected by performing the detection process for detecting the PG when the sensor 10 is located at the second position P2. Depending on the location of the second position P2, the sensor 10 is capable of detecting detachment of the medium, which is not intended by a user. Note that the printing apparatus 1 according to Example 1 may be configured not to perform the detection process for detecting the PG when the sensor 10 is located at the second position P2.

The printing apparatus 1 according to Example 1 includes, as illustrated in FIG. 6, the print head 7. The print head 7 is capable of ejecting ink onto the medium in the movement direction A between one end portion locating on the set position 14 side (the other side of the ejecting start position 15 side) of the tray 4 when the tray 4 is in the set position 14 and another end portion locating on the ejecting start position 15 side (the other side of the set position 14 side) of the tray 4 when the tray 4 is located at the ejecting start position 15. The first position P1 and the second position P2 are located on the ejecting start position 15 side (the opposite side of the set position 14 side) with respect to the print head 7 in the movement direction A. Therefore, in the printing apparatus 1 according to Example 1, the sensor 10 is prevented from obstructing when the medium is set in the tray 4, for example.

However, the configuration of the printing apparatus 1 is not limited to this example. In the following, another example of the printing apparatus 1 will be described, in which the first position P1 and the second position P2 are arranged in a different manner from the first position P1 and the second position P2 in the printing apparatus 1 according to Example 1.

EXAMPLE 2

Figure 7:
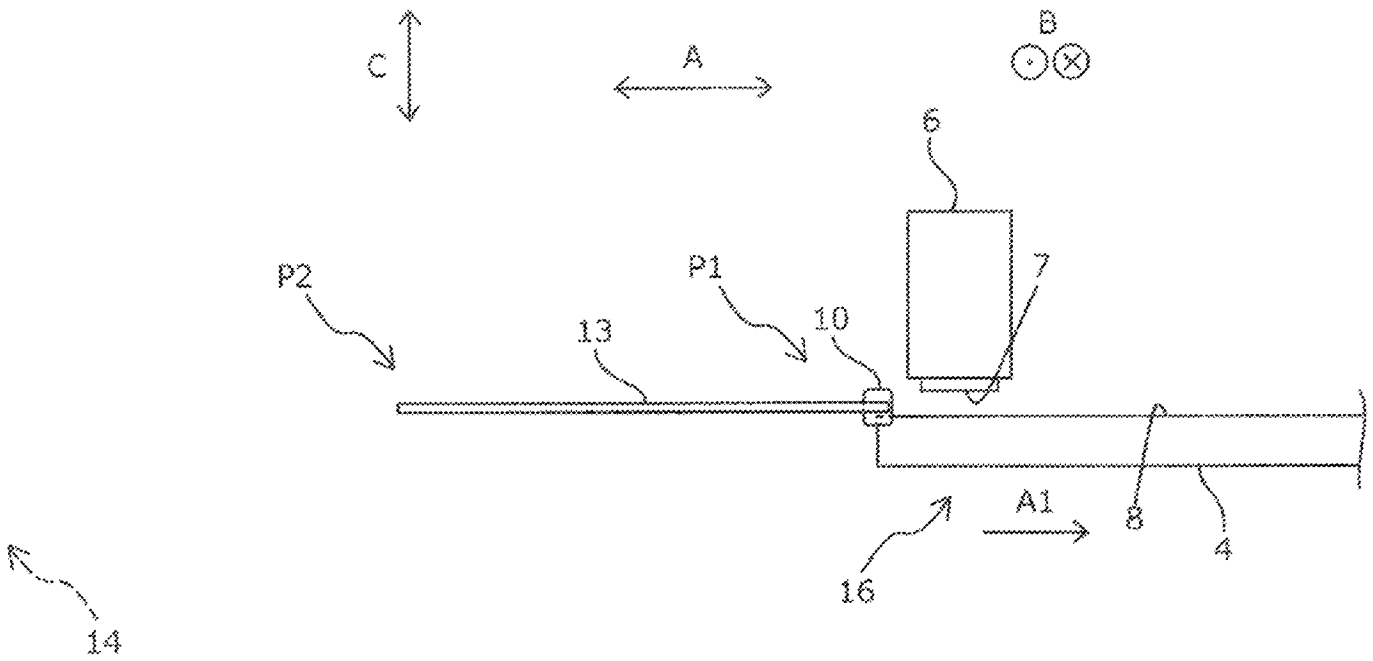
FIG. 7 is a schematic side view illustrating main components of a printing apparatus according to Example 2 of the disclosure.
Figure 8:
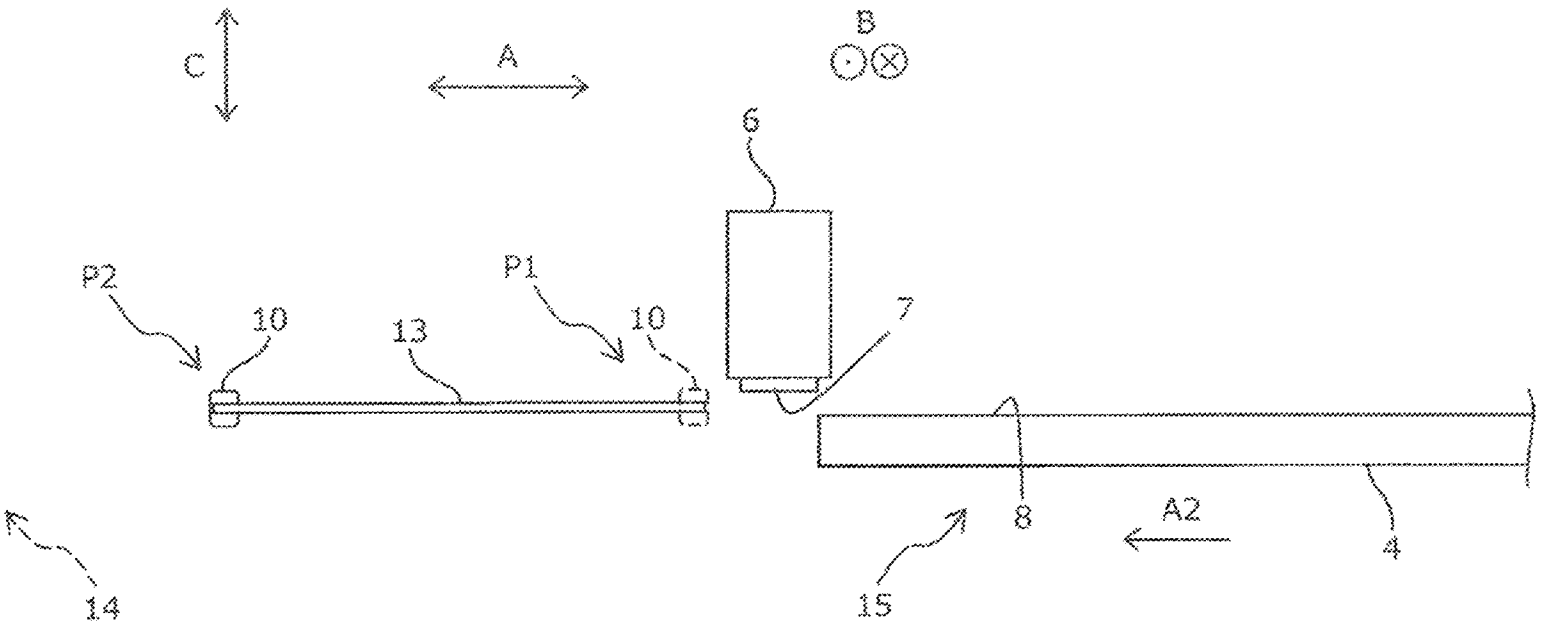
FIG. 8 is a schematic side view illustrating the main components of the printing apparatus according to Example 2 of the disclosure.

FIGS. 7 and 8

FIGS. 7 and 8 are schematic side views each illustrating a peripheral area of the sensor 10 of a printing apparatus 1 according to Example 2. FIG. 7 corresponds to FIG. 5 for the printing apparatus 1 according to Example 1, and FIG. 8 corresponds to FIG. 6 for the printing apparatus 1 according to Example 1. Common components to the components in the above-described Example 1 are denoted by identical reference signs, and detailed descriptions of those components will be omitted. The printing apparatus 1 according to Example 2 has an identical configuration to the configuration of the printing apparatus 1 according to Example 1 except for the locations of the first position P1 and the second position P2 (in other words, a movable range of the sensor 10).

The printing apparatus 1 according to Example 2 also causes the tray 4 to move in the direction A1 from the set position 14 to the PG measurement end position 16, which is a position of the tray 4 in the movement direction A as illustrated in FIG. 7. The printing apparatus 1 then causes the tray 4 to further move from the PG measurement end position 16 in the direction A1 and to be located at the ejecting start position 15. Subsequently, the printing apparatus 1 performs a printing operation (an ink-ejecting process) while moving the tray 4 in the direction A2. While the printing apparatus 1 causes the tray 4 to move from the set position 14 to the PG measurement end position 16, the sensor 10 is located at the first position P1. In the meantime, while the tray 4 is located at a position where the sensor 10 is capable of detecting the PG in the movement direction A, the sensor 10 detects the PG (the PG detection process). Once the tray 4 is detached from the position where the sensor 10 is capable of detecting the PG at the first position P1 in the movement direction A (in other words, an end portion of the tray 4 in the direction A1 is detected), the sensor 10 moves to the second position P2 as illustrated in FIG. 8.

As illustrated in FIG. 8, in the printing apparatus 1 according to Example 2, like in the printing apparatus 1 according to Example 1, the print head 7 is capable of ejecting ink onto a medium in the movement direction A between one end portion locating on the set position 14 side of the tray 4 when the tray 4 is located at the set position 14 and another end portion locating on the ejecting start position 15 side of the tray 4 when the tray 4 is located at the ejecting start position 15. As illustrated in FIGS. 7 and 8, the first position P1 and the second position P2 are located on the set position 14 side with respect to the print head 7, in the movement direction A. That is, as illustrated in FIGS. 7 and 8, the PG measurement end position 16 may be located closer to the set position 14 than the ejecting start position 15. Therefore, in the printing apparatus 1 according to Example 2, a conveyance path of the medium on the ejecting start position 15 side in the movement direction A is shortened efficiently, in particular. By controlling the sensor 10 to perform the detection process for detecting the PG also when the sensor 10 is located at the second position P2, the sensor 10 is capable of detecting detachment of the medium, which is not intended by a user, while an ejecting operation is performed.

EXAMPLE 3

Figure 9:
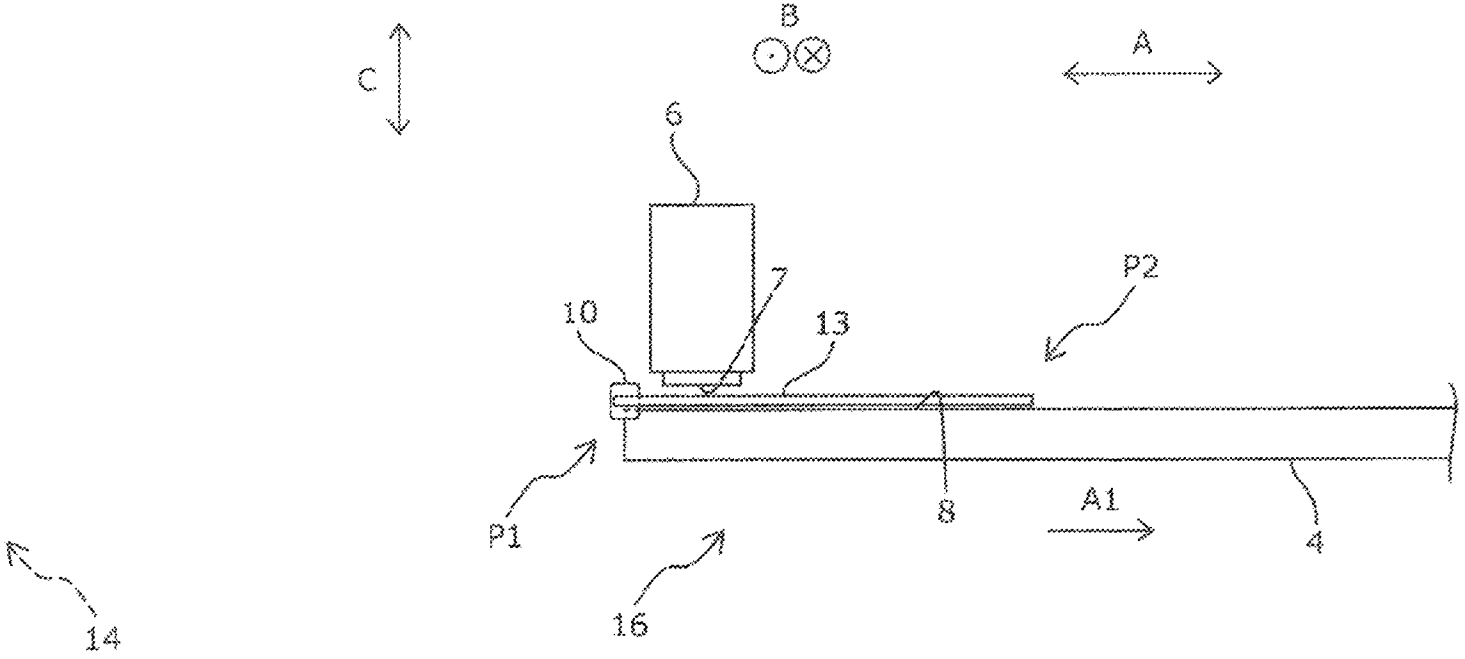
FIG. 9 is a schematic side view illustrating main components of a printing apparatus according to Example 3 of the disclosure.
Figure 10:
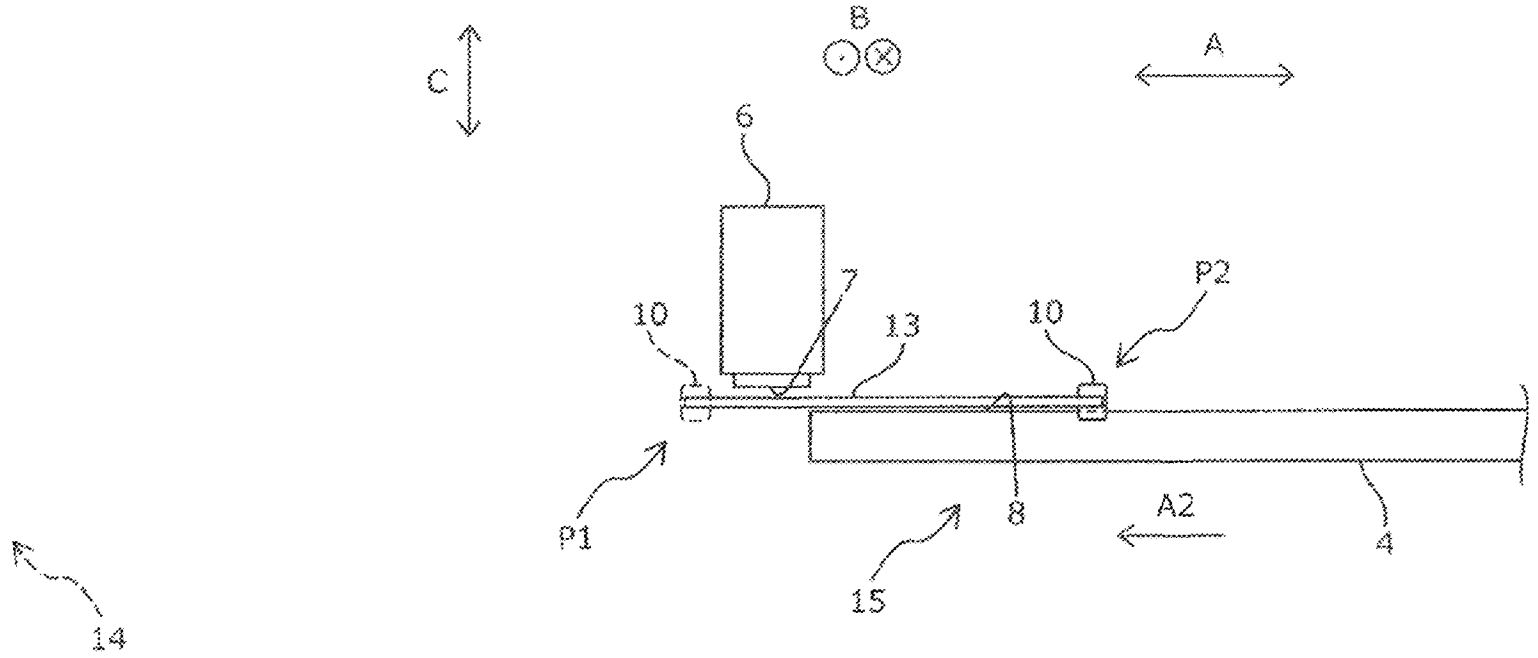
FIG. 10 is a schematic side view illustrating the main components of a printing apparatus according to Example 3 of the disclosure.

FIGS. 9 and 10

FIGS. 9 and 10 are schematic side views each illustrating a peripheral area of the sensor 10 of a printing apparatus 1 according to Example 3. FIG. 9 corresponds to FIG. 5 for the printing apparatus 1 according to Example 1, and FIG. 10 corresponds to FIG. 6 for the printing apparatus 1 according to Example 1. Common components to the components in the above-described Example 1 and Example 2 are denoted by identical reference signs, and detailed descriptions of those components will be omitted. The printing apparatus 1 according to Example 3 has an identical configuration to the configuration of the printing apparatus 1 according to Example 1 or Example 2 except for the locations of the first position P1 and the second position P2 (in other words, the movable range of the sensor 10).

The printing apparatus 1 according to Example 3 also causes the tray 4 to move in the direction A1 from the set position 14 to the PG measurement end position 16 which is a position of the tray 4 in the movement direction A as illustrated in FIG. 9. The printing apparatus 1 then causes the tray 4 to further move from the PG measurement end position 16 in the direction A1 and to be located at the ejecting start position 15. Subsequently, the printing apparatus 1 performs the printing operation (the ink-ejecting process) while moving the tray 4 in the direction A2. While the printing apparatus 1 causes the tray 4 to move from the set position 14 to the PG measurement end position 16, the sensor 10 is located at the first position P1. In the meantime, while the tray 4 is located at a position where the sensor 10 is capable of detecting the PG in the movement direction A, the sensor 10 detects the PG (the PG detection process). Once the tray 4 is detached from the position where the sensor 10 is capable of detecting the PG at the first position P1 in the movement direction A (in other words, moves in the direction A1), the sensor 10 moves to the second position P2 as illustrated in FIG. 10.

As illustrated in FIG. 10, in the printing apparatus 1 according to Example 3, like in the printing apparatus 1 according to Example 1 or Example 2, the print head 7 is capable of ejecting ink onto a medium in the movement direction A between one end portion locating on the set position 14 side of the tray 4 when the tray 4 is located at the set position 14 and another end portion locating on the ejecting start position 15 side of the tray 4 when the tray 4 is located at the ejecting start position 15. As illustrated in FIG. 10, of the first position P1 and the second position P2, one (the first position P1) is located on the set position 14 side with respect to the print head 7 in the movement direction A, and the other one (the second position P2) is located on the ejecting start position 15 side with respect to the print head 7 in the movement direction A. Therefore, in the printing apparatus 1 according to Example 3, imbalance in the conveyance path of the medium is prevented (in other words, imbalance in weight of the printing apparatus 1 in the movement direction A is prevented).

In particular, as illustrated in FIG. 10, in the printing apparatus 1 according to Example 3, of the first position P1 and the second position P2, the first position P1 is located on the set position 14 side with respect to the print head 7 in the movement direction A, and the second position P2 is located on the ejecting start position 15 side with respect to the print head 7 in the movement direction A. Therefore, in the printing apparatus 1 according to Example 3, an interference substance is detected on the set position 14 side, and thus the interference substance is detected soon after the medium is set. When the ejecting operation proceeds and an amount of ink applied to the medium increases, a crease may occur on a rear side portion of the medium in the direction A2 along with swelling of the medium. By controlling the sensor 10 to perform the detection process for detecting the PG also when the sensor 10 is located at the second position P2, the sensor 10 is capable of detecting such a crease.

EXAMPLE 4

Figure 11:
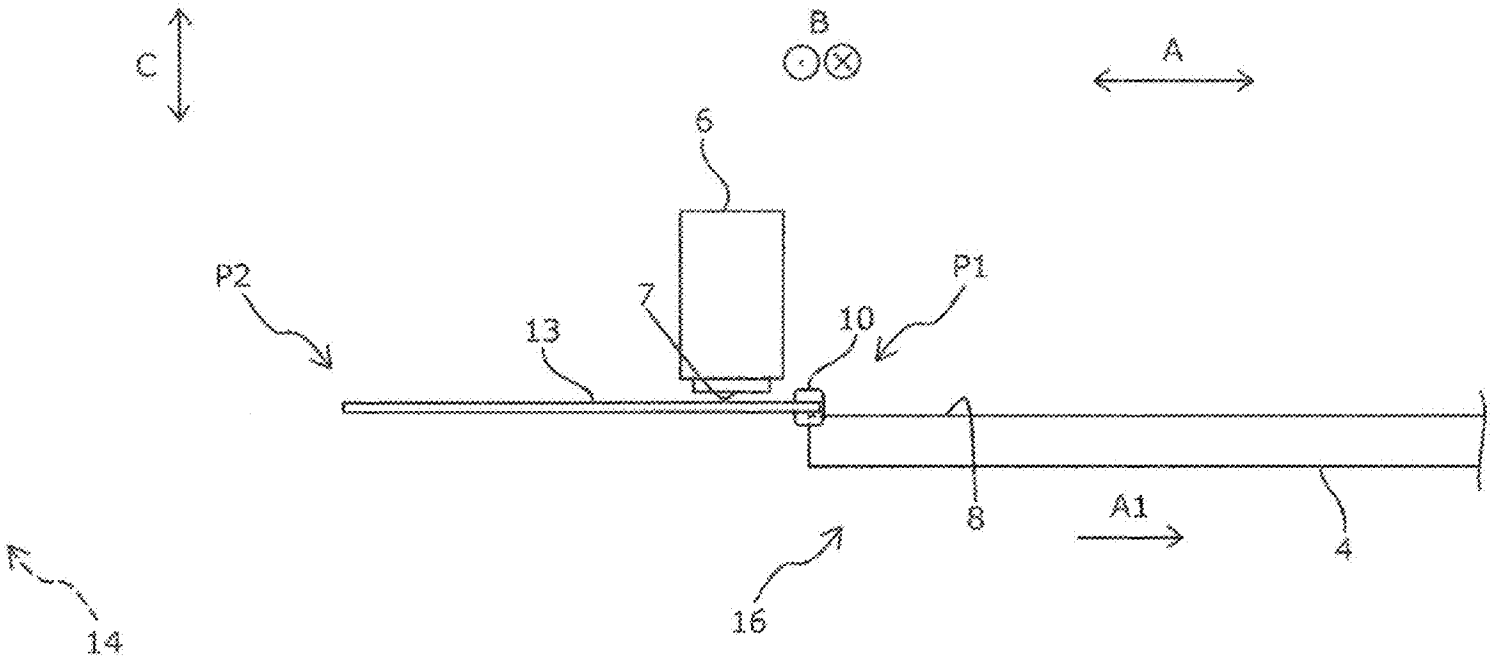
FIG. 11 is a schematic side view illustrating main components of a printing apparatus according to Example 4 of the disclosure.
Figure 12:
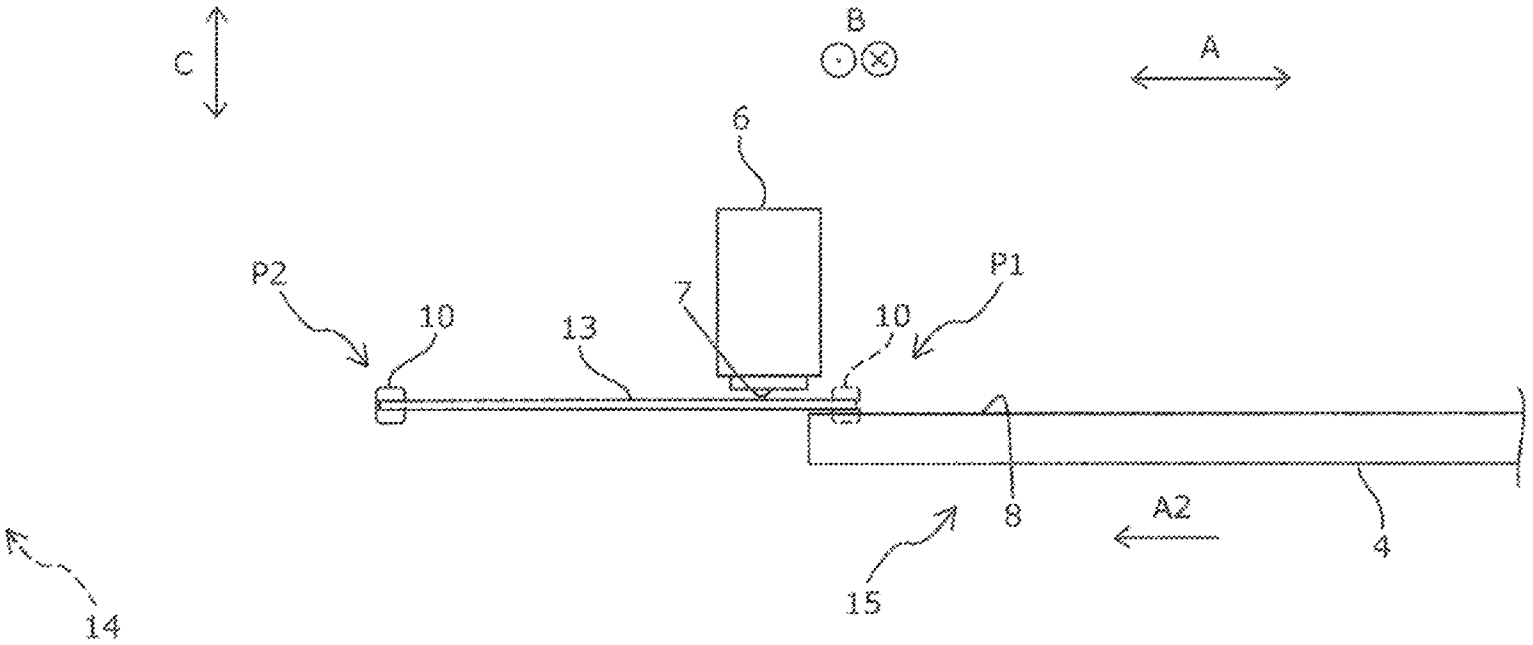
FIG. 12 is a schematic side view illustrating the main components of the printing apparatus according to Example 4 of the disclosure.

FIGS. 11 and 12

FIGS. 11 and 12 are schematic side views each illustrating a peripheral area of the sensor 10 of a printing apparatus 1 according to Example 4. FIG. 11 corresponds to FIG. 5 for the printing apparatus 1 according to Example 1, and FIG. 12 corresponds to FIG. 6 for the printing apparatus 1 according to Example 1. Common components to the components in the above-described Example 1 to Example 3 are denoted by identical reference signs, and detailed descriptions of those components will be omitted. The printing apparatus 1 according to Example 3 has an identical configuration to the configuration of the printing apparatus 1 according to Example 1 to Example 3 except for the locations of the first position P1 and the second position P2 (in other words, the movable range of the sensor 10).

The printing apparatus 1 according to Example 4 also causes the tray 4 to move in the direction A1 from the set position 14 to the PG measurement end position 16 which is a position of the tray 4 in the movement direction A as illustrated in FIG. 11. The printing apparatus 1 then causes the tray 4 to move from the PG measurement end position 16 in the direction A2 and to be located at the ejecting start position 15. Subsequently, the printing apparatus 1 performs the printing operation (the ink-ejecting process) while moving the tray 4 in the direction A2. While the printing apparatus 1 causes the tray 4 to move from the set position 14 to the PG measurement end position 16, the sensor 10 is located at the first position P1. In the meantime, while the tray 4 is located at a position where the sensor 10 is capable of detecting the PG in the movement direction A, the sensor 10 detects the PG (the PG detection process). Once the tray 4 is detached from the position where the sensor 10 is capable of detecting the PG at the first position P1 in the movement direction A (in other words, the tray 4 is moved to the PG measurement end position 16), the sensor 10 moves to the second position P2 as illustrated in FIG. 12.

As illustrated in FIG. 12, in the printing apparatus 1 according to Example 4, like in the printing apparatus 1 according to Example 1 to Example 3, the print head 7 is capable of ejecting ink onto a medium in the movement direction A between one end portion locating on the set position 14 side of the tray 4 when the tray 4 is located at the set position 14 and another end portion locating on the ejecting start position 15 side of the tray 4 when the tray 4 is located at the ejecting start position 15. As illustrated in FIG. 12, of the first position P1 and the second position P2, one (the second position P2) is located on the set position 14 side with respect to the print head 7 in the movement direction A, and the other (the first position P1) is located on the ejecting start position 15 side with respect to the print head 7 in the movement direction A. Therefore, also in the printing apparatus 1 according to Example 4, imbalance in the conveyance path of the medium is prevented in the movement direction A, like in the printing apparatus 1 according to Example 3.

In particular, as illustrated in FIG. 12, in the printing apparatus 1 according to Example 4, of the first position P1 and the second position P2, the first position P1 is located on the ejecting start position 15 side with respect to the print head 7 in the movement direction A, and the second position P2 is located on the set position 14 side with respect to the print head 7 in the movement direction A. Therefore, in the printing apparatus 1 according to Example 4, an interference substance is detected on the ejecting start position 15 side, and thus the interference substance is detected close to the ink-ejecting area of the print head 7 (in other words, immediately before an ejecting operation). By controlling the sensor 10 to perform the detection process for detecting the PG also when the sensor 10 is located at the second position P2, the sensor 10 is capable of detecting detachment of the medium, which is not intended by a user, while an ejecting operation is performed.

Note that the disclosure is not intended to be limited to the above-described examples, and many variations are possible within the scope of the disclosure as disclosed in the appended claims. Such variations also fall within the scope of the disclosure.

This application claims priority under 35 U.S.C. § 119 to Japanese Patent Application No. 2017-137223, filed Jul. 13, 2017. The entire disclosure of Japanese Patent Application No. 2017-137223 is hereby incorporated herein by reference.

What is claimed is:

1. A liquid ejecting apparatus comprising:

an ejecting unit capable of ejecting a liquid;

a support unit configured to support a medium onto which the liquid is ejected, the support unit being movable in a movement direction between a set position where the medium is set and an ejecting start position where the ejecting unit starts ejecting the liquid; and a detector configured to detect whether an interference substance which is a substance that causes an interference with the ejecting unit is present on the support unit, wherein the detector is movable between a first position and a second position, a distance between the second position and the ejecting unit being longer than a distance between the first position and the ejecting unit, in the movement direction.

2. The liquid ejecting apparatus according to claim 1, wherein the ejecting unit is capable of ejecting the liquid onto the medium between a first end portion locating on the set position side of the support unit when the support unit is located at the set position and a second end portion locating on the ejecting start position side of the support unit when the support unit is located at the ejecting start position, in the movement direction, and the first position and the second position are located on the ejecting start position side with respect to the ejecting unit, in the movement direction.

3. The liquid ejecting apparatus according to claim 2, further comprising:

a movement mechanism configured to move the detector to the first position and the second position; and a controller configured to control the detector to move to the first position and the second position, wherein the controller locates the detector at the second position at least when the ejecting unit ejects the liquid.

4. The liquid ejecting apparatus according to claim 1, wherein the ejecting unit is capable of ejecting the liquid onto the medium between a first end portion locating on the set position side of the support unit when the support unit is located at the set position and a second end portion locating on the ejecting start position side of the support unit when the support unit is located at the ejecting start position, in the movement direction, and the first position and the second position are located on the set position side with respect to the ejecting unit, in the movement direction.

5. The liquid ejecting apparatus according to claim 4, further comprising:

a movement mechanism configured to move the detector to the first position and the second position; and a controller configured to control the detector to move to the first position and the second position, wherein the controller locates the detector at the second position at least when the ejecting unit ejects the liquid.

6. The liquid ejecting apparatus according to claim 1, wherein the ejecting unit is capable of ejecting the liquid onto the medium between a first end portion locating on the set position side of the support unit when the support unit is located at the set position and a second end portion locating on the ejecting start position side of the support unit when the support unit is located at the ejecting start position, in the movement direction, and one of the first position and the second position is located on the set position side with respect to the ejecting unit in the movement direction, and the other one of the first position and the second position is located on the ejecting start position side with respect to the ejecting unit in the movement direction.

7. The liquid ejecting apparatus according to claim 6, wherein the first position is located on the set position side with respect to the ejecting unit in the movement direction, and the second position is located on the ejecting start position side with respect to the ejecting unit in the movement direction.

8. The liquid ejecting apparatus according to claim 7, further comprising:

a movement mechanism configured to move the detector to the first position and the second position; and a controller configured to control the detector to move to the first position and the second position, wherein the controller locates the detector at the second position at least when the ejecting unit ejects the liquid.

9. The liquid ejecting apparatus according to claim 6, wherein the first position is located on the ejecting start position side with respect to the ejecting unit in the movement direction, and the second position is located on the set position side with respect to the ejecting unit in the movement direction.

10. The liquid ejecting apparatus according to claim 9, further comprising:

a movement mechanism configured to move the detector to the first position and the second position; and a controller configured to control the detector to move to the first position and the second position, wherein the controller locates the detector at the second position at least when the ejecting unit ejects the liquid.

11. The liquid ejecting apparatus according to claim 6, further comprising:

a movement mechanism configured to move the detector to the first position and the second position; and a controller configured to control the detector to move to the first position and the second position, wherein the controller locates the detector at the second position at least when the ejecting unit ejects the liquid.

12. The liquid ejecting apparatus according to claim 1, further comprising:

a movement mechanism configured to move the detector to the first position and the second position; and a controller configured to control the detector to move to the first position and the second position, wherein the controller locates the detector at the second position at least when the ejecting unit ejects the liquid.

* * * * *